US007033237B2

(12) United States Patent
Spagnuolo

(10) Patent No.: US 7,033,237 B2
(45) Date of Patent: Apr. 25, 2006

(54) INFLATABLE SAFETY APPARATUS

(75) Inventor: Vito Spagnuolo, Legnano (IT)

(73) Assignee: The Life Belt S.r.l., Milan (IT)

( * ) Notice: Subject to any disclaimer, the term of this patent is extended or adjusted under 35 U.S.C. 154(b) by 50 days.

(21) Appl. No.: 10/833,220

(22) Filed: Apr. 27, 2004

(65) Prior Publication Data

US 2005/0020155 A1 Jan. 27, 2005

(30) Foreign Application Priority Data

May 26, 2003 (IT) ..... MI2003A1051
Feb. 12, 2004 (IT) ..... MI20040050 U

(51) Int. Cl.
*B63C 9/125* (2006.01)

(52) U.S. Cl. ..... 441/108; 441/120

(58) Field of Classification Search ..... 441/88, 441/106, 108, 113, 120, 92, 93, 94
See application file for complete search history.

(56) References Cited

U.S. PATENT DOCUMENTS 2,970,326 A 2/1961 Keefe
3,130,424 A * 4/1964 Santangelo ..... 441/94
3,144,667 A 8/1964 Dobbs
3,414,920 A 12/1968 Beaton
4,925,418 A * 5/1990 Mariotto nee Amiel ..... 441/92
5,022,879 A 6/1991 DiForte
5,702,279 A * 12/1997 Brown ..... 441/108
6,231,411 B1 5/2001 Vinay

FOREIGN PATENT DOCUMENTS

| | | |
|---|---|---|
| DE | 2.202.902 | 8/1973 |
| DE | 198.50.187 | 5/2000 |
| EP | 0 325 994 A1 | 8/1989 |
| FR | 2 603 494 A1 | 3/1988 |

* cited by examiner

*Primary Examiner*—Sherman Basinger
(74) *Attorney, Agent, or Firm*—Bucknam and Archer

(57) ABSTRACT

There is provided an inflatable safety apparatus (10, 10') which is manually or automatically operated having a compressed gas bottle (17, 20) with an operation rod (25, 54) in combination with an inflatable element (15, 18) which is initially folded upon itself as an open ring and housed in a ribbon-shaped case (13, 26) secured to the user's waist. The inflatable element (15, 18) is connected to the ribbon-shaped case (13, 26) by extensible tapes (27, 60) or ducts (14, 14', 16, 16') whose extension allows positioning the inflatable element at the height of the user's armpit.

14 Claims, 5 Drawing Sheets

INFLATABLE SAFETY APPARATUS

The present invention refers to an inflatable safety apparatus.

More particularly, the present invention refers to a safety apparatus to be used in water, that can be inflated if necessary and is advantageously embedded into the garment used by the bather or in an accessory such as a belt placed around the waist. Said garment is generally constituted by a bath suit, particularly a slip or a bath trunk; therefore the opportunity of embedding the inflatable safety apparatus to other kinds of garments such as diving suits and/or accessories thereof is not excluded.

It is known that, when in water, bathers fear of finding themselves in difficulties due to unforeseeable events. These kinds of situations may occur due to physical tiredness that could cause muscular cramps, due to illness or panic coming upon. In these cases the bather cannot swim and reach the shore by his/her own means and in absence of a prompt rescue the drowning danger could occur.

On the other hand, it is physically impossible that bathers, especially experienced swimmers, could always wear lifebuoys, belts or jackets inflated with air or made of light or spongy material such as cork. These accessories are in fact an obstacle for the bather that, due to them, is forced to swim in an unnatural position with part of the body afloat.

In addition to the uneasiness, the use of such devices makes the bather feel ill at ease. If, on one hand it is normal that the safety jackets are used also by experienced swimmers in particular conditions such as races, this does not occur when they simply bathe; but it is in these circumstances that the most serious dangers may occur.

To this purpose, various inflatable devices worn by the user and fastened to the waist or to other parts of the body are known; these devices, for example, are described in U.S. Pat. No. 2,970,326, U.S. Pat. No. 3,144,667, U.S. Pat. No. 3,414,920 and in the German and European patents no. DE198.50.187, no. DE2.202.902 and no. EP 0.325.994. These solutions substantially refer to simple inflatable lifebuoys that do not assure a proper stabilization and floating effect and, moreover, they comprise complex operation systems of the inflating means.

Object of the present invention is to remedy the abovementioned drawbacks.

More particularly, object of the present invention is the provision of an inflatable safety apparatus that can be usually worn by the bather without hampering his/her movements, unnaturally change his/her body position-when bathing, or being cumbersome.

A further object of the invention is the provision of an inflatable safety apparatus as described above the user can operate only when necessary and being invisible outside.

A further object of the invention is the provision of an inflatable safety apparatus that can assure a high resistance and reliability level in time and it is easily manufactured at low costs.

These and other purposes are reached by the inflatable safety apparatus of the present invention that-can be used in water and be manually or automatically operated, comprising at least one compressed gas bottle provided with an operation rod combined with at least one inflatable element being originally folded up as an open ring and embedded into a ribbon-shaped case to tie the user's waist; said at least one inflatable element being connected to the ribbon-shaped case by extensible means whose extension allows placing the same inflatable element at the user's armpit height when inflated.

The building and functional features of the inflatable safety apparatus of the present invention can be better understood by the detailed description that follows wherein reference is made to the attached tables of drawings representing a preferred embodiment which is given only by way of non-limitative example wherein.

Figure 3:
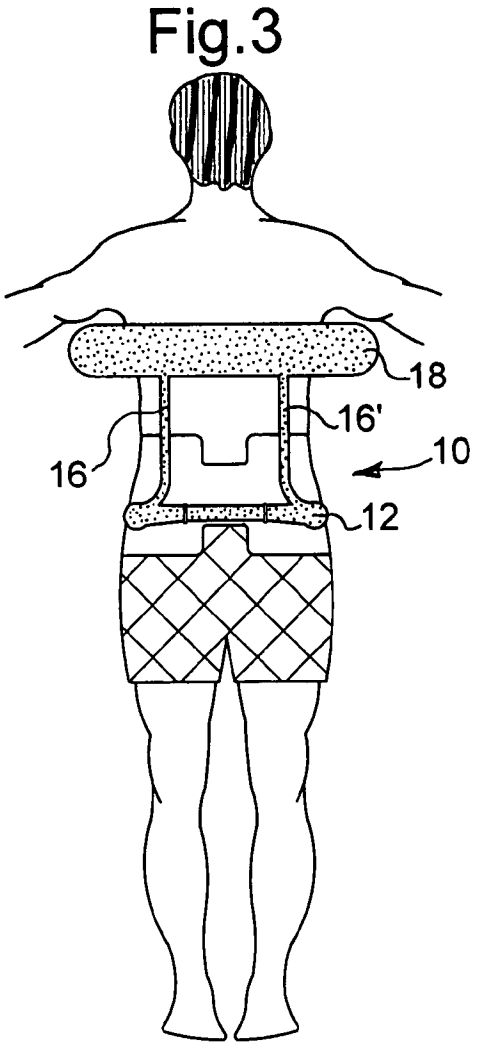
FIG. 3 is a schematic view of the opposite rear side of the same safety apparatus of the previous Figures worn by the user in operation.

With reference to the FIGS. from 1 to 7, the inflatable safety apparatus of the present invention, marked in its whole with 10, comprises a substantially circular section tubular chamber 12, made of an extensible plastic material open ring extending into one or more integral ducts, preferably into two opposite couples of integral ducts 14, 14' and 16, 16'. Said ducts 14, 14' and 16, 16' are vertically oriented and develop in this direction with respect to the tubular chamber 12 and they seamlessly connect to an open ring lifebuoy-shaped inflatable element 18 with a slightly higher section than said chamber 12 and being in communication with it through said ducts 14, 14' and 16, 16'.

Figure 7:
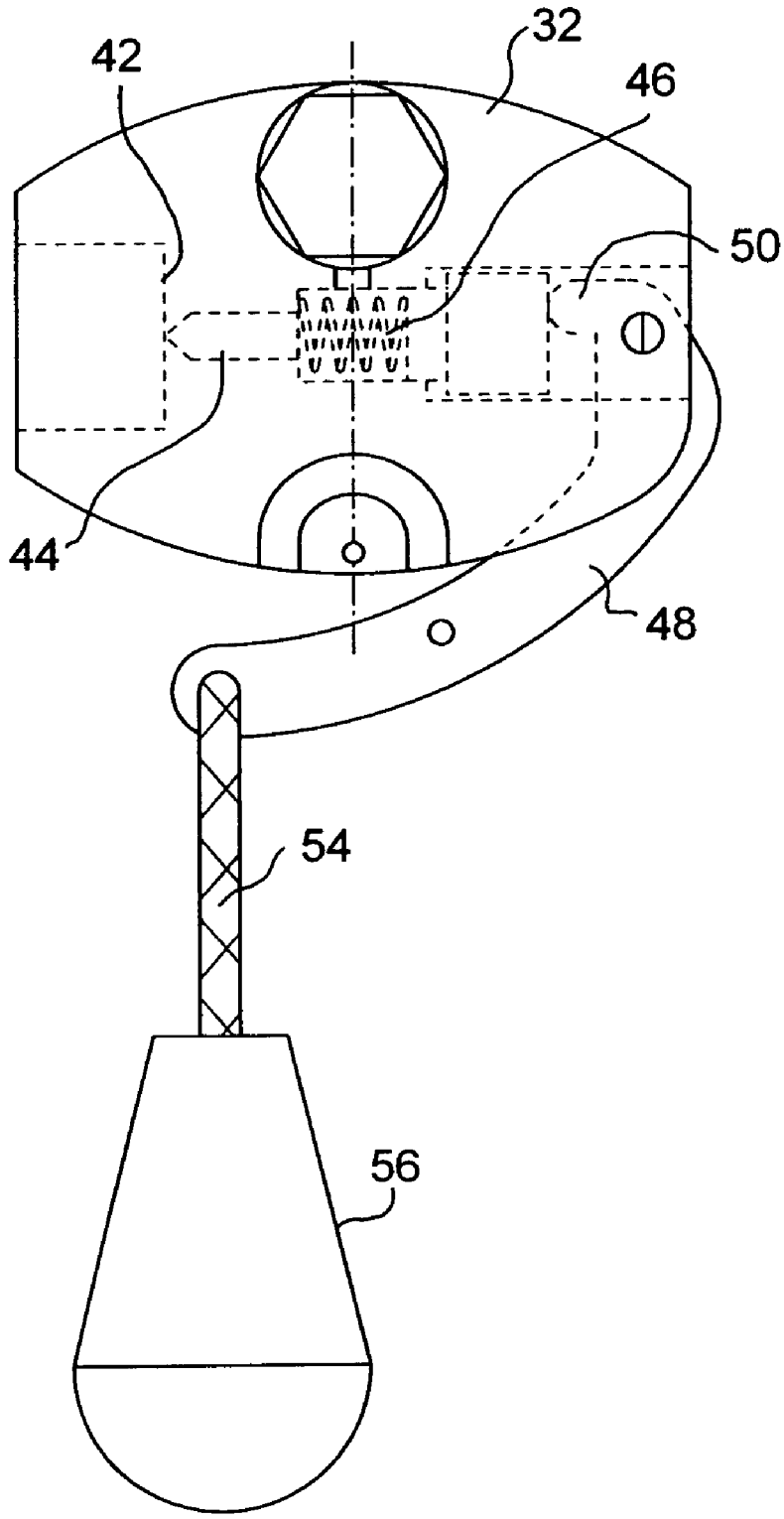
FIG. 7 is a schematic front partial section view of the inflatable safety apparatus operation means of the present invention.

At least one known bottle or container 20 containing pressurised fluid made of inert gas such as atmospheric air or $CO_2$ provided with a threaded mouthpiece 34 on one end is connected to said chamber 12 and/or inflatable element 18. Said container 20 comprises a known valve assembly 32 applied to the threaded mouthpiece 34 of the container 20. Said container 20 and the relevant valve assembly 32 are briefly described here below in order to better understand the way the apparatus of the present invention operates. The container 20 is provided with a threaded mouthpiece 34 to one end whereupon said valve assembly 32 embedding a mobile plug 36 is screwed and elastically tensioned by a helical spring 38 sliding into a chamber 40 that is orthogonally obtained into the same valve assembly 32 with respect to the exposed surface of the mouthpiece 34 of the container 20. Said mouthpiece 34 is shielded by a membrane 42 made of plastic or other suitable material forming the cap of the container 20. Said membrane 42 is properly dimensioned and stabilised to form a barrier at the exit of the pressurised fluid which is released from the same container 20 only after a proper action is carried out by the user. To this purpose, the usual valve assembly 32 comprises a punctiform or pin-shaped body 44 directed towards the mouthpiece 42 of the container 20 tensioned by a helical spring 46 and axially operated by a lever 48 connected to the same valve assembly 32 and placed on it. As shown in detail in FIG. 7, one of the ends of the lever 48, marked with 50, is aligned with the longitudinal axis of the pin 44, while the other end, marked with 52, is free and connected to a rod 54 whereupon a grasp knob 56 or the like is fastened. Said knob freely protrudes from the valve assembly 32 to be grasped and pulled by the user if necessary. It is easily understood that the pull exercised on the knob 56 connected to the lever 48 makes the latter swing so that the pin 44 pierces the membrane 42 of the container 20 releasing the pressurised fluid contained in it. To this purpose and according to the present invention, the valve assembly 32 is tightly fastened to the tubular chamber 12, for example by means of heat sealing and/or adhesive collars 58. This constraint is obtained in correspondence of a tang 32' of the valve assembly 32 partially engaging into a hole made on the same tubular chamber 12. Therefore, the pressurised fluid inside the case 20 fills said tubular chamber 12, the ducts 14–14', 16–16' and the inflatable element 18 after the pin 44 has pierced the membrane 42 of the same container 20.

Figure 2:
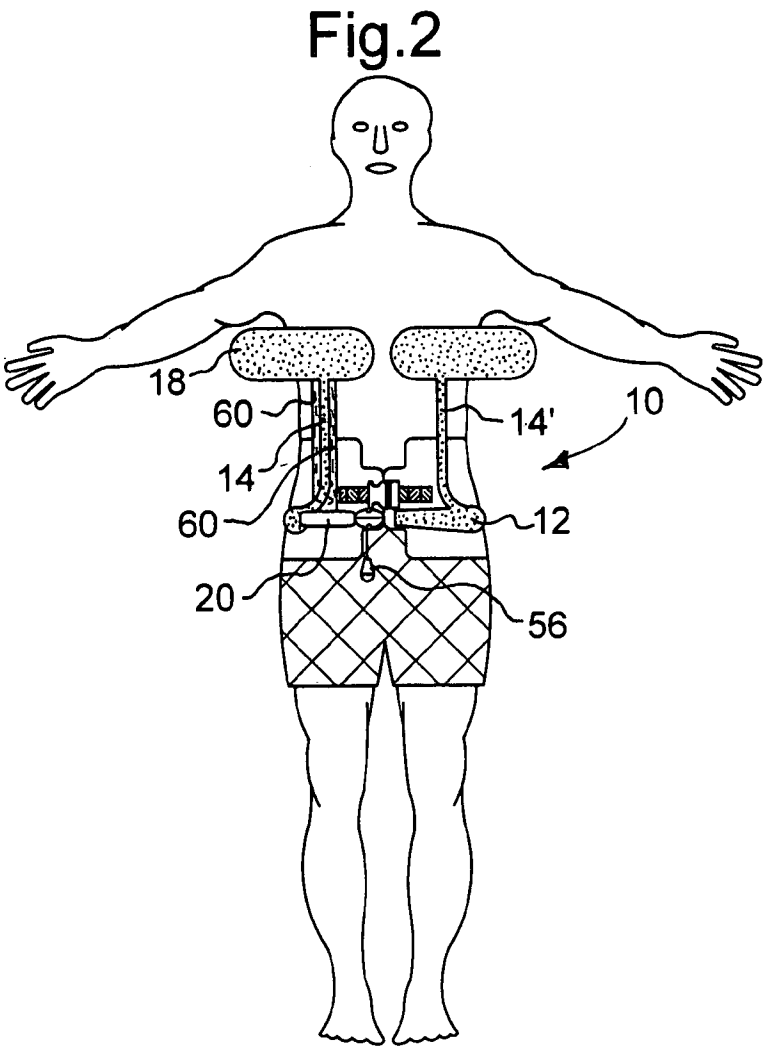
FIG. 2 is a schematic view of the front side of the safety apparatus of FIG. 1 worn by the user in operation.
Figure 4:
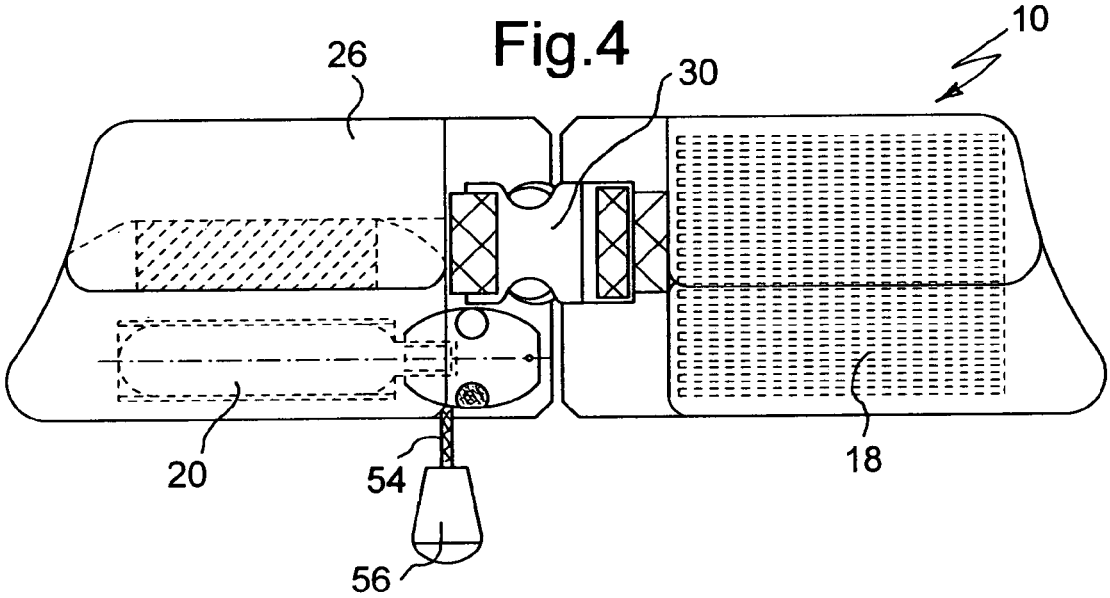
FIG. 4 is a schematic partial section front view of the case containing the inflatable safety apparatus.

Said container 20, according to the illustrative non-limitative embodiment, is housed in correspondence with one end of the mentioned chamber 12, as shown in particular in FIGS. 2 and 4. The opposite free ends of the tubular chamber 12 as the one of the ring-shaped inflatable element 18 are tight closed for instance by heat sealing and/or adhesive materials. Said opposite ends of the tubular chamber 12, wherein in correspondence with one of them the case 20 is housed, face in the opposite direction on the front side of the user body along the abdominal area.

Figure 1:
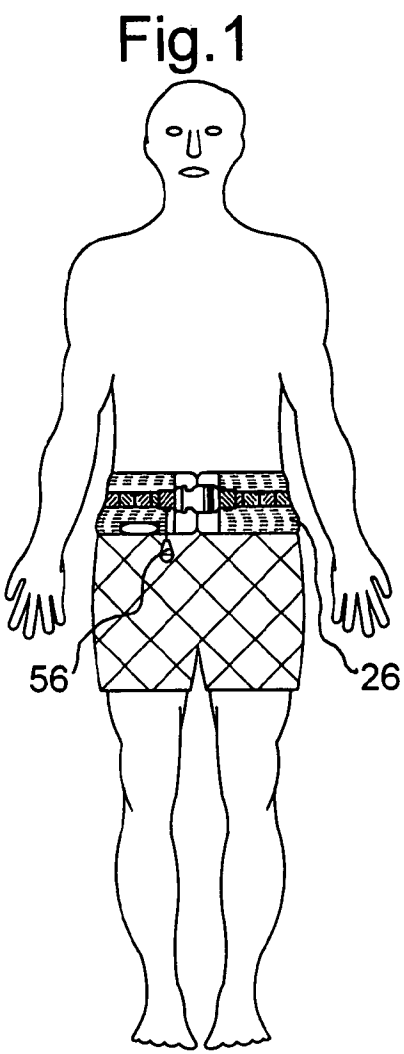
FIG. 1 is a schematic view from the front side of the inflatable safety apparatus of the present invention worn by the user at rest.
Figure 6:
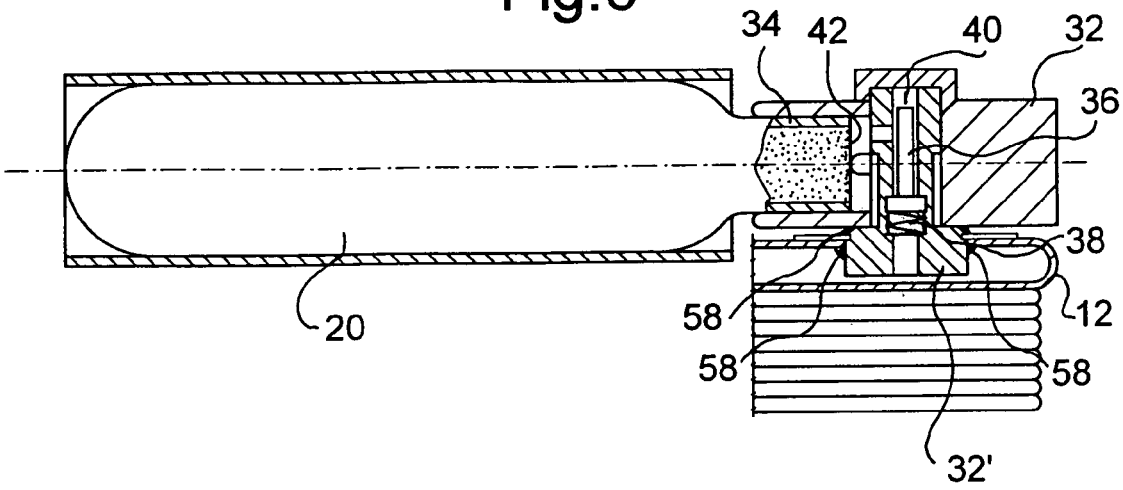
FIG. 6 is a schematic partial section view of the safety apparatus and of its case.
Figure 5:
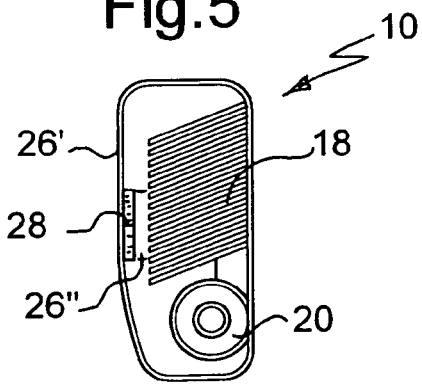
FIG. 5 is a schematic cross-section view of the case of the previous FIG. 4.

According to a preferred and non-limitative embodiment, the inflatable safety apparatus 10, as shown in the attached Figures, is advantageously embedded into a ribbon-shaped case 26 shown in particular in FIGS. 1, 4 and 5. Said case made of any suitable material and preferably of natural or synthetic fabric, in its development, defines a strip which is folded onto itself along its larger sides. The edges or end laps 26'–26" of said case 26 are at least partly overlapped and reciprocally fastened between them in one or more points through temporary approaching stabilization means.

Said temporary stabilization means, marked with 28 in FIG. 5, are preferably made of one or more "Velcro" type or removable adhesive strips. The ribbon-shaped case 26, which substantially forms a belt the user can wear around the waist, is provided with connection and alignment means of its opposite free ends being for example constituted by a small connecting frame or by an elastic clip in buckle 30 made of plastic or other suitable material. The material making the ribbon-shaped case 26 is preferably at least partly an elastic or elasticised material to make the positioning and the stabilisation around the user's waist of the same case embedding the safety apparatus 10 and relevant pressurised fluid container 20 easier. From the ribbon-shaped case 26 a pull means or knob 56 protrudes, if necessary, two matched knobs in presence of two containers 20 forming the grasping means allowing the user to pulling the tie rod 54 piercing and opening the membrane 42 of the container 20 releasing the pressurised fluid contained in it are provided.

As can be noticed particularly from FIGS. 4 and 5, at least the inflatable element 18 of the safety apparatus 10 is preferably compressed on itself, inside the case 26 by repeated bellows folds being therefore understood that both said element 18, the tubular chamber 12 and the relevant connection ducts 14–14' and/or 16–16' can be casually compressed into the same case. The latter can be obviously integrated along the upper edge of a bath suit or other similar garment that is substantially placed around the user's waist.

According to a preferred and non-limitative embodiment, each of the ducts 14,14' and/or 16/16' connecting and allowing the communication of the inflatable tubular chamber 12 with the inflatable element 18 a ribbon 60 having a suitable width is associated in order to stabilize along the user's body the same ducts when inflated. Said ribbons 60, one of which is shown in FIG. 2, are advantageously made of flexible plastic material and are fastened by heat sealing to the ducts 14,14' and 16,16'. For the manufacturing of the ribbons 60 the same material of the ducts is preferably used, or any other natural or synthetic material. The ribbons 60 are placed in such a way to prevent the contact with the user's body both along the front abdominal area and the rear one of the back and are fastened to the opposite free ends by heat sealing or adhesives, respectively to the inflatable tubular chamber 12 and to the inflatable element 18.

From the above-mentioned description, it is easily understood the way the safety apparatus object of the present invention operates; once it is operated, it creates a complete rescue harness around the bust of the bather wearing it. In emergency situations, the user pulls outwards the knob 56 and the rod 54 connected to it operating the lever 48 and the punctiform or pin-shaped body 44 piercing the membrane 42 of the container 20. Following to this piercing, the fluid goes out from the container 20 and immediately distributes into the tubular chamber 12 and reaches the inflatable element 18 through the ducts 14–14' and 16–16'. When said chamber 12 starts expanding due to the effect of the inflating it, the case 26 opens overcoming the resistance of the "Velcro" type or adhesive strips and allows unwinding and inflating the remaining part of the apparatus made of said ducts and inflatable element 18. FIGS. from 1 to 3 schematically show the safety apparatus worn by the user when it is not inflated (FIG. 1) and in operation (FIGS. 2 and 3); from the latter the whole position and configuration of the inflated apparatus are shown. The user is provided with a first reduced-section lifebuoy corresponding to the tubular chamber 12 that ties his/her waist and also with a second broader lifebuoy corresponding to the inflatable element 18 that extends and ties his/her body at the armpit height. These elements form a complete rescue harness.

Figure 8:
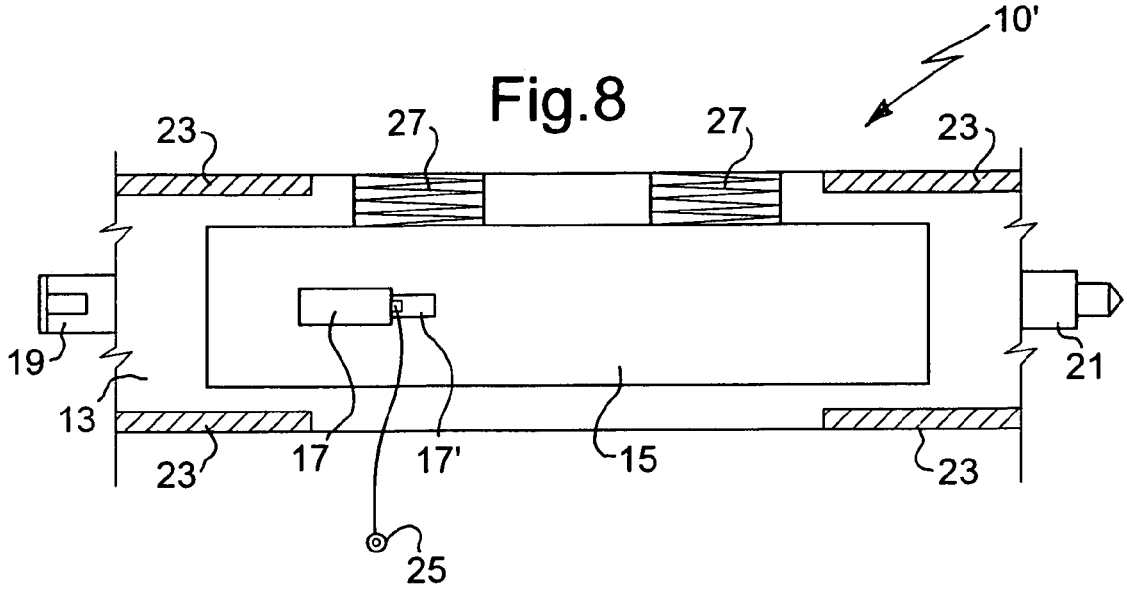
FIGS. 8 and 9 are front schematic views of the safety apparatus of the present invention according to an alternative embodiment.

FIGS. from 8 to 11 refer to an alternative and simplified embodiment of the inflatable safety apparatus of the present invention. According to this embodiment, said apparatus, marked in its whole with 10' in FIG. 8 showing it in non-operation conditions, comprises a flexible ribbon-shaped element 13 made of fabric or natural or synthetic material and at least of an inflatable element 15 associated to said case and provided with one or more known bottles 17 containing pressurized gas, generally $CO_2$.

The ribbon-shaped case 13 ties the user's waist and, for the purpose, is provided with connection means of the opposite ends. Said connection means are preferably made of at least one plastic or other suitable material buckle formed by two conventional components 19, 21 suitable to elastically connect between them by means of a groove-and-tongue joint. Said components 19, 21 are advantageously fastened by interposition of one or more ribbons at the ends of the case 13 in order to allow the accurate adjustment at the user's waist. Instead of the mentioned buckle, other fastening and adjustment means can be matched to the ribbon-shaped case 13, such as two opposite strips of suitable material one of which being provided with buckle with tongue and the other one provided with multiple spaced holes in order to form a belt.

Figure 9:
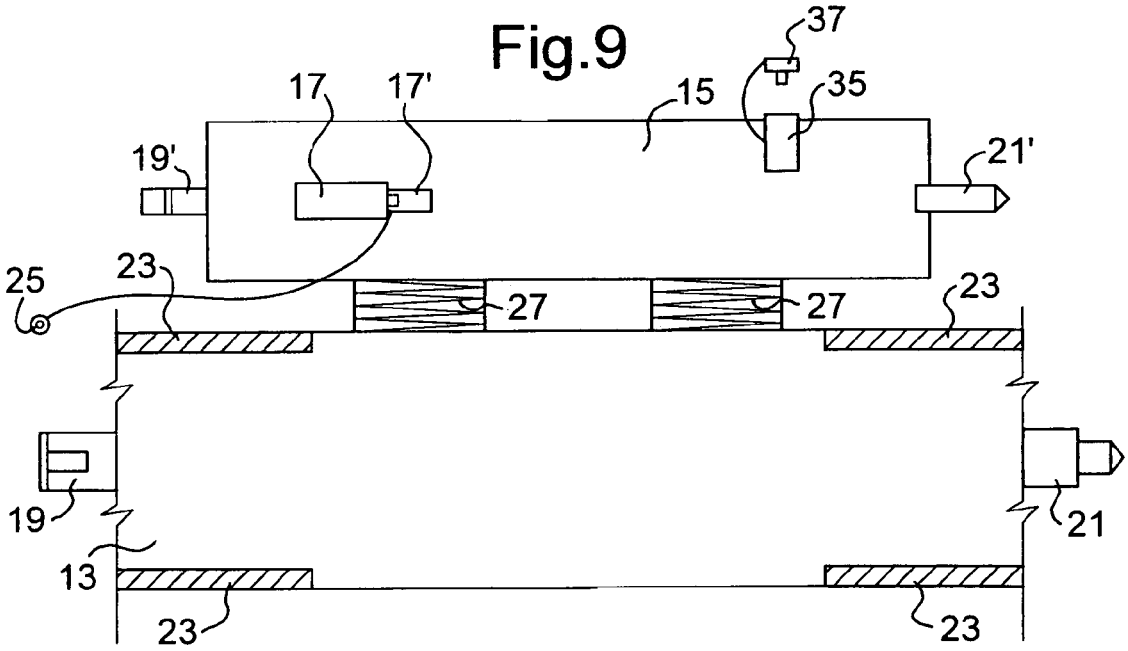
Figure 11:
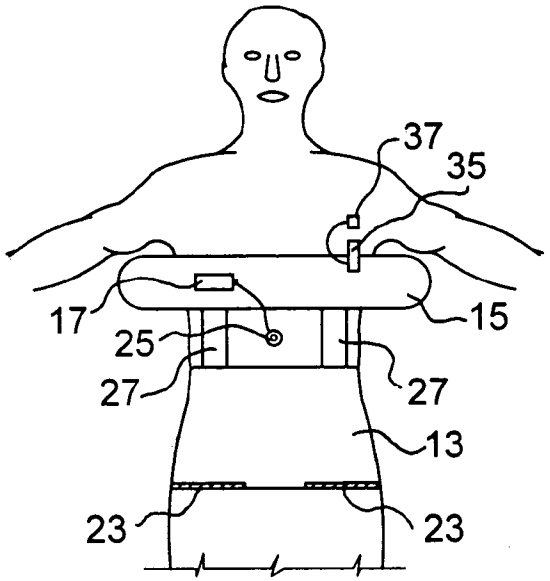
FIGS. 10 and 11 are front schematic views of the same safety apparatus shown in FIGS. 8 and 9 worn by the user, both in operation and in non-operation conditions.

A similar buckle or equivalent adjustable means, marked with 19', 21' in FIG. 9 are advantageously fastened to the opposite ends of the inflatable element 15, so that it takes the lifebuoy shape.

The ribbon-shaped element 13 is advantageously arranged in order to enclose the inflatable element 15 and the relevant bottle/s 17 of pressurized gas and, to the purpose, it is provided with removable screwing closing means in the vertical or height direction; said closing means are preferably made of one or more strips 23 of Velcro fastened with adhesives or sewn along parts of its edge or in another suitable position. The Velcro strips 23 allow folding and closing the ribbon-shaped element 13 that, in such a way, embeds the inflatable element 15 in order to form an abdominal belt the user can easily wear and properly adjust around his/her waist.

The same Velcro strips 23 form an easily removable closing when the device 10' is operated, the inflating of the element 15 through the bottle/s 17 automatically detaches the edges of the ribbon-shaped element 13 joint to the strips 23, thus allowing the exposition of the same element 15 as described here below.

The operation of the compressed gas bottle/s 17 is obtained by known devices, being for example constituted by a rod 25, that when operated by the user, opens the valve of the same bottle and consequently sets the gas free that expands into the inflatable element 15. The rod is obviously outside the folded ribbon-shaped case 13 as shown in FIG. 3, in such a way that in emergency situations the user can grasp it and pull it.

The bottle/s 17 is/are directly fastened to the inflatable element 15 with interposition of a valve support 17' and they are in communication with a mouthpiece of the same inflatable element. The valve support 17', of the known type, is fastened to the latter with any suitable means such as adhesives or heat sealing.

According to an embodiment given by way of example shown in FIGS. from 8 to 11, the ribbon-shaped case 13 embeds one lifebuoy inflatable element 15 connected to the same case by one or more tapes 27 of suitable length made of fabric or natural or synthetic material or of other suitable material.

The opposite ends of the tapes 27 are respectively fastened to the inflatable element 15 and to the ribbon-shaped case 13 by adhesives, heat sealing or other suitable means. The length of the same tapes 27, that are curled up on themselves when the device is not in operation, allows the inflatable element, once inflated, to rise up along the user's bust and places at the armpit height. Once this position is reached, the inflated element 15 is stabilized due to the effect of the tapes 27 that are fastened to the ribbon-shaped case 13.

The ribbon-shaped case 13 is, in its turn, properly stabilized around the user's waist by the mentioned buckle or other suitable means. Therefore, said inflatable means 15 cannot slip off from the user's body even in case the user accidentally rises up his/her arms as he/she is unconscious. The floating is therefore assured and the element 15 when inflated is placed in the most appropriate position to keep the head out of the water and protected from waves.

Figure 12:
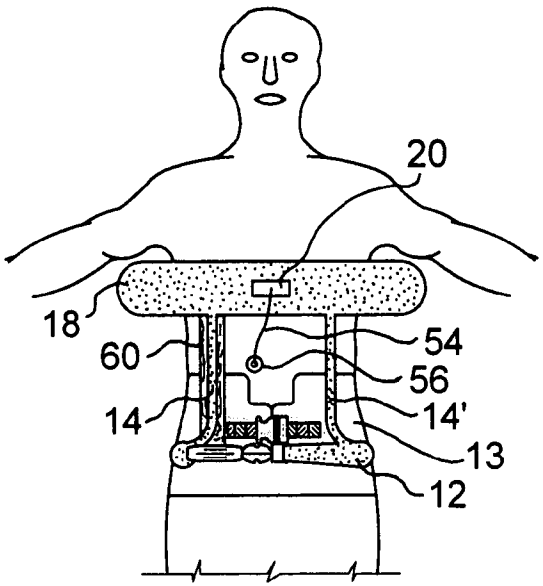
FIGS. 12 shows a schematic front view of the safety apparatus of FIGS. from 1 to 7 according to a further alternative embodiment.
Figure 10:
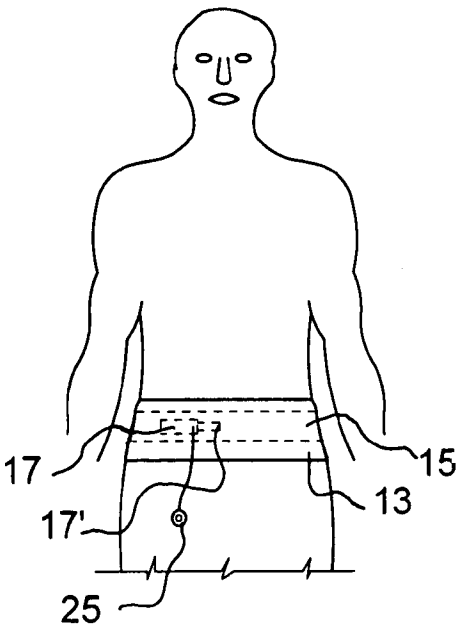

FIG. 12 schematically shows the device of the present invention according to a variant embodiment connecting to the one of the previous FIGS. from 1 to 6 from which it mainly differentiates for the positioning of the bottle or container of pressurized fluid. In said Figure, wherein, for the common parts, the same numerical references as the ones of the embodiment shown in FIGS. from 1 to 6 are used, the pressurized fluid container 20 is fastened to the inflatable element 18 to be placed, once inflated, at the height of the user's armpit.

The compressed gas bottle/s 17 or 20 can be of the automatic type, i.e. provided with a valve which in contact with the water immediately releases the gas and inflates the inflatable element/s 12, 15 or 18. This embodiment, preventing the user from pulling the rod 25 or 54 is particularly suitable to be used on boats because the device automatically operates in case the user accidentally falls into the water.

The bottle/s 17 and or 20 is/are coupled with a known valve support 17', i.e. of the kind manufactured by Halkey Roberts called "manual inflator" series V870. The bottle 17 and/or 20 is manually screwed to said support into a proper threaded seat.

The inflatable elements 15, 18 if necessary or alternatively the tubular inflatable chamber 12, are provided with a projecting mouthpiece 35 with a relevant removable closing cap 37 to deflate the same element once rescue function is over and fold it into the ribbon-shaped case 13 or 26 to be subsequently used after having replaced the used bottle 17 or 20 with a new one. Said mouthpiece 35 also allows inflating the tubular element/s 15, 18 and 12 by mouth without operating the bottle 17 or 20 in case the user wants to stay into the water and float without effort.

Even though the present invention has been described above with reference to some embodiments that are given only by way of non-limitative example, people skilled in the art can make many changes and variants according to the above description. It is therefore clear that the present invention is meant to include all the changes and variants falling within the spirit and the protection scope of the following claims.

What is claimed is:

1. An inflatable safety apparatus (10,10') which is manually or automatically operated, comprising:

(a) a ribbon-shaped case (13, 26) forming a belt and consisting of a strip of at least partly elastic or elasticized material folded onto itself along its larger sides, said ribbon-shaped case having opposing ends and being provided with connection means for said opposing ends;

(b) a substantially circular section tubular inflatable chamber (12) having the shape of an open ring with opposing free ends tightly sealed and faced in the opposite direction on the front side of the user's body along the abdominal area;

(c) at least one open ring lifebuoy-shaped inflatable element (15, 18) having opposing ends and a section slightly higher than that of the inflatable chamber (12);

(d) flexible extensible ducts (14, 14', 16, 16', 27, 60) each connected and communicating at a first end, with the inflatable element (15, 18) and, at an opposite second end, with the tubular inflatable chamber (12), the extension of said ducts allowing the positioning of said inflatable element (15, 18) at the height of the user's armpit;

(e) at least one pressurized gas bottle (17, 20) operatively communicating with inflatable chamber (12) or said inflatable element (15, 18) and provided with a valve assembly (32) and an operation rod (25, 54);

said tubular inflatable chamber (12), inflatable, element (15, 18) and flexible ducts each being folded onto itself and together with said at least one pressurized gas bottle being housed in said ribbon-shaped case (13, 26).

2. The inflatable safety apparatus as defined in claim 1, wherein said gas bottle operatively communicates with one of the opposing free ends of said tubular inflatable chamber.

3. The inflatable safety apparatus as defined in claim 1, wherein said gas bottle is housed in said inflatable element.

4. The safety apparatus as defined in claim 1, wherein said ribbon-shaped case (13,26) is made of fabric or natural and/or synthetic material and it is provided with a buckle (30) or two complementary components (19,21) integral to the opposing ends of said case and elastically engaging between them.

5. The inflatable safety apparatus as defined in claim 4, wherein said inflatable element (15,18) is provided with a buckle or fastening adjusting means (19',21') secured to the opposing ends of said inflatable element.

6. The inflatable safety apparatus as defined in claim 1, wherein said ribbon-shaped case (13,26) is provided with removable fastening means (23,28) placed along one or more parts of the edge and/or of the surface of the same ribbon-shaped case.

7. The inflatable safety apparatus as defined in claim 6, wherein the removable fastening means are hook and loop fasteners arranged in strips (23).

8. The inflatable safety apparatus as defined in claim 1, wherein said ribbonshaped case (13,26) is at least partly elastic or elasticized and is integrated into a bathing trunk.

9. The inflatable safety apparatus as defined in claim 1, wherein said compressed gas bottle (17,20) is fastened by heat sealing and/or adhesive collars (58) or valve supports (17') to at least one of said inflatable element (15, 18) or said tubular inflatable chamber (12).

10. The inflatable safety apparatus as defined in claim 1, wherein a ribbon or tape (27,60) is associated to one or more flexible extensible ducts (14,14', 16,16') connecting the inflatable element (15,18) to the tubular inflatable chamber (12).

11. The inflatable safety apparatus as defined in claim 10, wherein the ribbon or tape (27, 60) is fastened at its opposing free ends respectively to the tubular inflatable chamber (12) and to the inflatable element (18).

12. The inflatable safety apparatus as defined in claim 1, wherein the tubular inflatable chamber (12) is fastened at one or more points to the ribbon-shaped case (13,26) by adhesives, heat sealing or other fastening means.

13. The inflatable safety apparatus as defined in claim 1, wherein said at least one compressed gas bottle (17,20) is of the automatic operation type.

14. The inflatable safety apparatus as defined in claim 1, wherein said inflatable element (15,18) is provided with a projecting mouthpiece (35) with a removable closing cap (37).

* * * * *